US007059950B1

(12) United States Patent
Muldowney

(10) Patent No.: US 7,059,950 B1
(45) Date of Patent: Jun. 13, 2006

(54) CMP POLISHING PAD HAVING GROOVES ARRANGED TO IMPROVE POLISHING MEDIUM UTILIZATION

(75) Inventor: Gregory P. Muldowney, Earleville, MD (US)

(73) Assignee: Rohm and Haas Electronic Materials CMP Holdings, Inc., Wilmington, DE (US)

( * ) Notice: Subject to any disclaimer, the term of this patent is extended or adjusted under 35 U.S.C. 154(b) by 0 days.

(21) Appl. No.: 11/012,437

(22) Filed: Dec. 14, 2004

(51) Int. Cl.
*B24D 11/00* (2006.01)

(52) U.S. Cl. ..... 451/527; 451/530

(58) Field of Classification Search ..... 451/526–528, 451/530, 533–539
See application file for complete search history.

(56) References Cited

U.S. PATENT DOCUMENTS 5,177,908 A 1/1993 Tuttle
5,645,469 A 7/1997 Burke et al.
5,650,039 A 7/1997 Talieh
5,990,012 A 11/1999 Robinson et al.
6,089,966 A * 7/2000 Arai et al. ..... 451/533
6,120,366 A 9/2000 Lin et al.
6,241,596 B1 6/2001 Osterheld et al.
6,843,711 B1 1/2005 Muldowney
2002/0068516 A1 6/2002 Chen et al.
2002/0083577 A1* 7/2002 Suzuki ..... 29/603.16

FOREIGN PATENT DOCUMENTS

EP 1 114 697 A2 7/2001

* cited by examiner

*Primary Examiner*—Dung Van Nguyen
(74) *Attorney, Agent, or Firm*—Blake T. Biederman

(57) ABSTRACT

A polishing pad (104, 304, 404, 504) having an annular polishing track (152, 312, 412, 512) for polishing a wafer (120, 316, 416, 516). A plurality of grooves (112, 320, 420, 520) are arranged within the wafer track so that they are spaced from one another both radially and circumferentially relative to the rotational nature of pad and are at least partially non-circumferential relative to the pad.

10 Claims, 3 Drawing Sheets

CMP POLISHING PAD HAVING GROOVES ARRANGED TO IMPROVE POLISHING MEDIUM UTILIZATION

BACKGROUND OF THE INVENTION

The present invention generally relates to the field of chemical mechanical polishing (CMP). More particularly, the present invention is directed to a polishing CMP pad having grooves arranged to improve polishing medium utilization.

In the fabrication of integrated circuits and other electronic devices, multiple layers of conducting, semiconducting and dielectric materials are deposited onto and removed from a surface of a semiconductor wafer. Thin layers of conducting, semiconducting and dielectric materials may be deposited using a number of deposition techniques. Common deposition techniques in modem wafer processing include physical vapor deposition (PVD), also known as sputtering, chemical vapor deposition (CVD), plasma-enhanced chemical vapor deposition (PECVD) and electrochemical plating, among others. Common removal techniques include wet and dry isotropic and anisotropic etching, among others.

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful for removing undesired surface topography and surface defects, such as rough surfaces, agglomerated materials, crystal lattice damage, scratches and contaminated layers or materials.

Chemical mechanical planarization, or chemical mechanical polishing (CMP), is a common technique used to planarize workpieces such as semiconductor wafers. In conventional CMP, a wafer carrier, or polishing head, is mounted on a carrier assembly. The polishing head holds the wafer and positions the wafer in contact with a polishing layer of a polishing pad within a CMP apparatus. The carrier assembly provides a controllable pressure between the wafer and polishing pad. Simultaneously therewith, a slurry, or other polishing medium, is flowed onto the polishing pad and into the gap between the wafer and polishing layer. To effect polishing, the polishing pad and wafer are moved, typically rotated, relative to one another. The wafer surface is polished and made planar by chemical and mechanical action of the polishing layer and polishing medium on the surface. As the polishing pad rotates beneath the wafer, the wafer sweeps out a typically annular polishing track, or polishing region, wherein the wafer surface directly confronts the polishing layer.

Important considerations in designing a polishing layer include the distribution of polishing medium across the face of the polishing layer, the flow of fresh polishing medium into the polishing track, the flow of used polishing medium from the polishing track and the amount of polishing medium that flows through the polishing zone essentially unutilized, among others. One way to address these considerations is to provide the polishing layer with grooves. Over the years, quite a few different groove patterns and configurations have been implemented. Prior art groove patterns include radial, concentric-circular, Cartesian-grid and spiral, among others. Prior art groove configurations include configurations wherein the depth of all the grooves are uniform among all grooves and configurations wherein the depth of the grooves varies from one groove to another.

It is generally acknowledged among CMP practitioners that certain groove patterns result in higher slurry consumption than others to achieve comparable material removal rates. Circular grooves, which do not connect to the outer periphery of the polishing layer, tend to consume less slurry than radial grooves, which provide the shortest possible path for slurry to reach the pad perimeter under the forces resulting from the rotation of the pad. Cartesian grids of grooves, which provide paths of various lengths to the outer periphery of the polishing layer, hold an intermediate position.

Various groove patterns have been disclosed in the prior art that attempt to reduce slurry consumption and maximize slurry retention time on the polishing layer. For example, U.S. Pat. No. 6,241,596 to Osterheld et al. discloses a rotational-type polishing pad having grooves defining zigzag channels that generally radiate outward from the center of the pad. In one embodiment, the Osterheld et al. pad includes a rectangular "x-y" grid of grooves. The zigzag channels are defined by blocking selected ones of the intersections between the x- and y-direction grooves, while leaving other intersections unblocked. In another embodiment, the Osterheld et al. pad includes a plurality of discrete, generally radial zigzag grooves. Generally, the zigzag channels defined within the x-y grid of grooves or by the discrete zigzag grooves inhibit the flow of slurry through the corresponding grooves, at least relative to an unobstructed rectangular x-y grid of grooves and straight radial grooves. Another prior art groove pattern that has been described as providing increased slurry retention time is a spiral groove pattern that is assumed to push slurry toward the center of the polishing layer under the force of pad rotation.

Research and modeling of CMP to date, including state-of-the-art computational fluid dynamics simulations, have revealed that in networks of grooves having fixed or gradually changing depth, a significant amount of polishing slurry may not contact the wafer because the slurry in the deepest portion of each groove flows under the wafer without contact. While grooves must be provided with a minimum depth to reliably convey slurry as the surface of the polishing layer wears down, any excess depth will result in some of the slurry provided to polishing layer not being utilized, since in conventional polishing layers an unbroken flow path exists beneath the workpiece wherein the slurry flows without participating in polishing. Accordingly, there is a need for a polishing layer having grooves arranged in a manner that reduces the amount of underutilization of slurry provided to the polishing layer and, consequently, reduces the waste of slurry.

STATEMENT OF THE INVENTION

In one aspect of the invention, a polishing pad, comprising: a) a polishing layer configured to polish a surface of at least one of a magnetic, optical or semiconductor substrate in the presence of a polishing medium, the polishing layer including a rotational axis, an outer periphery and an annular polishing track concentric with the rotational axis; and a plurality of grooves formed in the polishing layer and comprising a first set of grooves located entirely within the annular polishing track, each groove in the first set of grooves: i) being spaced from other grooves in the first set of grooves in a radial direction relative to the rotational axis; ii) being spaced from other grooves in the first set of grooves in a circumferential direction relative to the polishing pad; and iii) having a longitudinal axis at least a portion of which is oriented non-circumferentially relative to the polishing pad forming a discontinuous flow for the polishing medium where land regions interrupt flow to the outer periphery.

In another aspect of the invention, a polishing pad, comprising: a) a polishing layer configured to polish a surface of at least one of a magnetic, optical or semiconductor substrate in the presence of a polishing medium, the polishing layer including: i) a rotational axis; ii) an outer periphery; iii) an annular polishing track concentric with the rotational axis; and iv) a peripheral region located between the annular polishing track and the outer periphery; and b) a plurality of grooves formed in the polishing layer and comprising: i) a first set of grooves located entirely within the annular polishing track, each of at least some of the grooves in the first set of grooves: A) spaced from others of the grooves in the first set of grooves in a radial direction relative to the rotational axis of the polishing layer; and B) spaced from others of the grooves in the first set of grooves in a circumferential direction relative to the polishing pad; and ii) a second set of grooves each located only in the annular polishing track and the peripheral region forming a discontinuous flow for the polishing medium where land regions interrupt flow to the outer periphery.

DETAILED DESCRIPTION OF THE INVENTION

Figure 1:
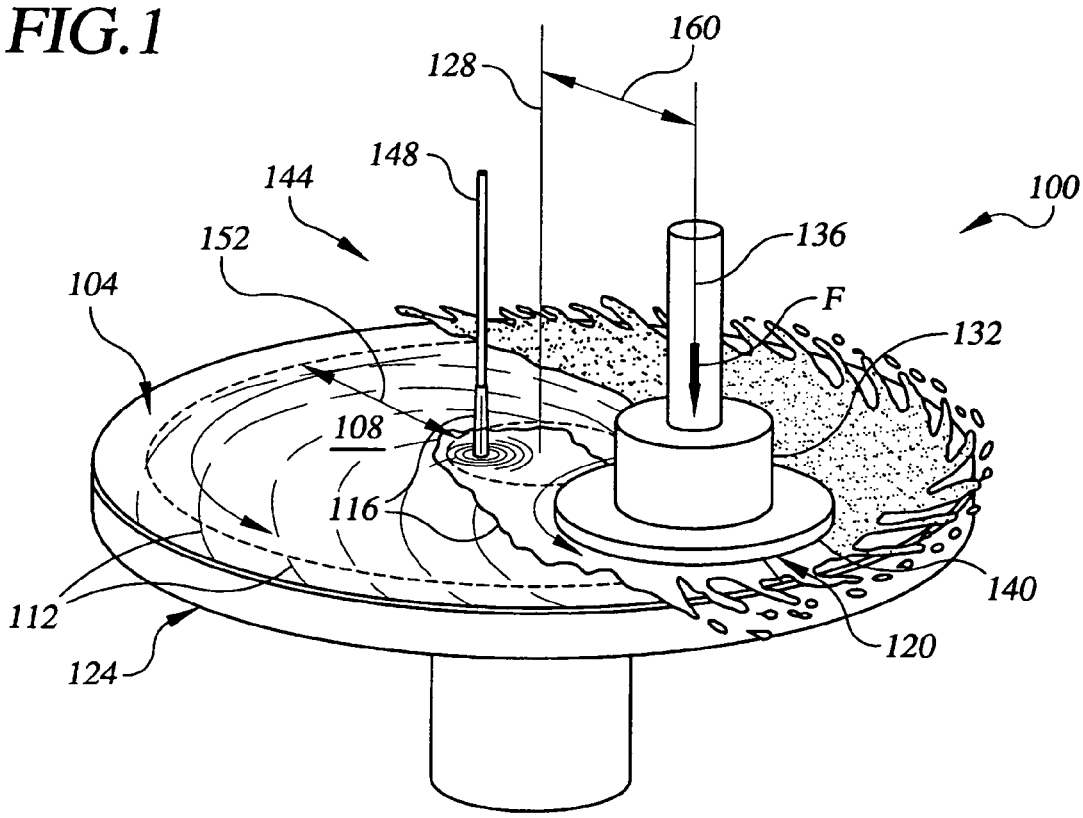
FIG. 1 is a partial perspective view of a chemical mechanical polishing (CMP) system of the present invention.

Referring now to the drawings, FIG. 1 shows in accordance with the present invention a chemical mechanical polishing (CMP) system, which is generally denoted by the numeral 100. CMP system 100 includes a polishing pad 104 having a polishing layer 108 that includes a plurality of grooves 112 arranged and configured for improving the utilization of a polishing medium 116 applied to the polishing pad during polishing of a semiconductor wafer 120 or other workpiece, such as glass, silicon wafers and magnetic information storage disks, among others. For convenience, the term "wafer" is used in the description below. However, those skilled in the art will appreciate that workpieces other than wafers are within the scope of the present invention. Polishing pad 104 and its unique features are described in detail below.

CMP system 100 may include a polishing platen 124 rotatable about an axis 128 by a platen driver (not shown). Platen 124 may have an upper surface on which polishing pad 104 is mounted. A wafer carrier 132 rotatable about an axis 136 may be supported above polishing layer 108. Wafer carrier 132 may have a lower surface that engages wafer 120. Wafer 120 has a surface 140 that confronts polishing layer 108 and is planarized during polishing. Wafer carrier 132 may be supported by a carrier support assembly (not shown) adapted to rotate wafer 120 and provide a downward force F to press wafer surface 140 against polishing layer 108 so that a desired pressure exists between the wafer surface and the polishing layer during polishing.

CMP system 100 may also include a supply system 144 for supplying polishing medium 116 to polishing layer 108. Supply system 144 may include a reservoir (not shown), e.g., a temperature controlled reservoir, that holds polishing medium 116. A conduit 148 may carry polishing medium 116 from the reservoir to a location adjacent polishing pad 104 where the polishing medium is dispensed onto polishing layer 108. A flow control valve (not shown) may be used to control the dispensing of polishing medium 116 onto pad 104.

During the polishing operation, the platen driver rotates platen 124 and polishing pad 104 and the supply system 144 is activated to dispense polishing medium 116 onto the rotating polishing pad. Polishing medium 116 spreads out over polishing layer 108 due to the rotation of polishing pad 104, including the gap between wafer 120 and polishing pad 104. The wafer carrier 132 may be rotated at a selected speed, e.g., 0 rpm to 150 rpm, so that wafer surface 140 moves relative to the polishing layer 108. The wafer carrier 132 may also be controlled to provide a downward force F so as to induce a desired pressure, e.g., 0 psi to 15 psi, between wafer 120 and polishing pad 104. Polishing platen 124 is typically rotated at a speed of 0 to 150 rpm. As polishing pad 104 is rotated beneath wafer 120, surface 140 of the wafer sweeps out a typically annular wafer track, or polishing track 152 on polishing layer 108.

It is noted that under certain circumstances polishing track 152 may not be strictly annular. For example, if surface 140 of wafer 120 is longer in one dimension than another and the wafer and polishing pad 104 are rotated at particular speeds such that these dimensions are always oriented the same way at the same locations on polishing layer 108, polishing track 152 would be generally annular, but have a width that varies from the longer dimension to the shorter dimension. A similar effect would occur at certain rotational speeds if surface 140 of wafer 120 were bi-axially symmetric, as with a circular or square shape, but the wafer is mounted off-center relative to the rotational center of that surface. Yet another example of when polishing track 152 would not be entirely annular is when wafer 120 is oscillated in a plane parallel to polishing layer 108 and polishing pad 104 is rotated at a speed such that the location of the wafer due to the oscillation relative to the polishing layer is the same on each revolution of the pad. In all of these cases, which are typically exceptional, polishing track 152 is still annular in nature, such that they are considered to fall within the coverage of the term "annular" as this term is used in the appended claims.

Figure 2:
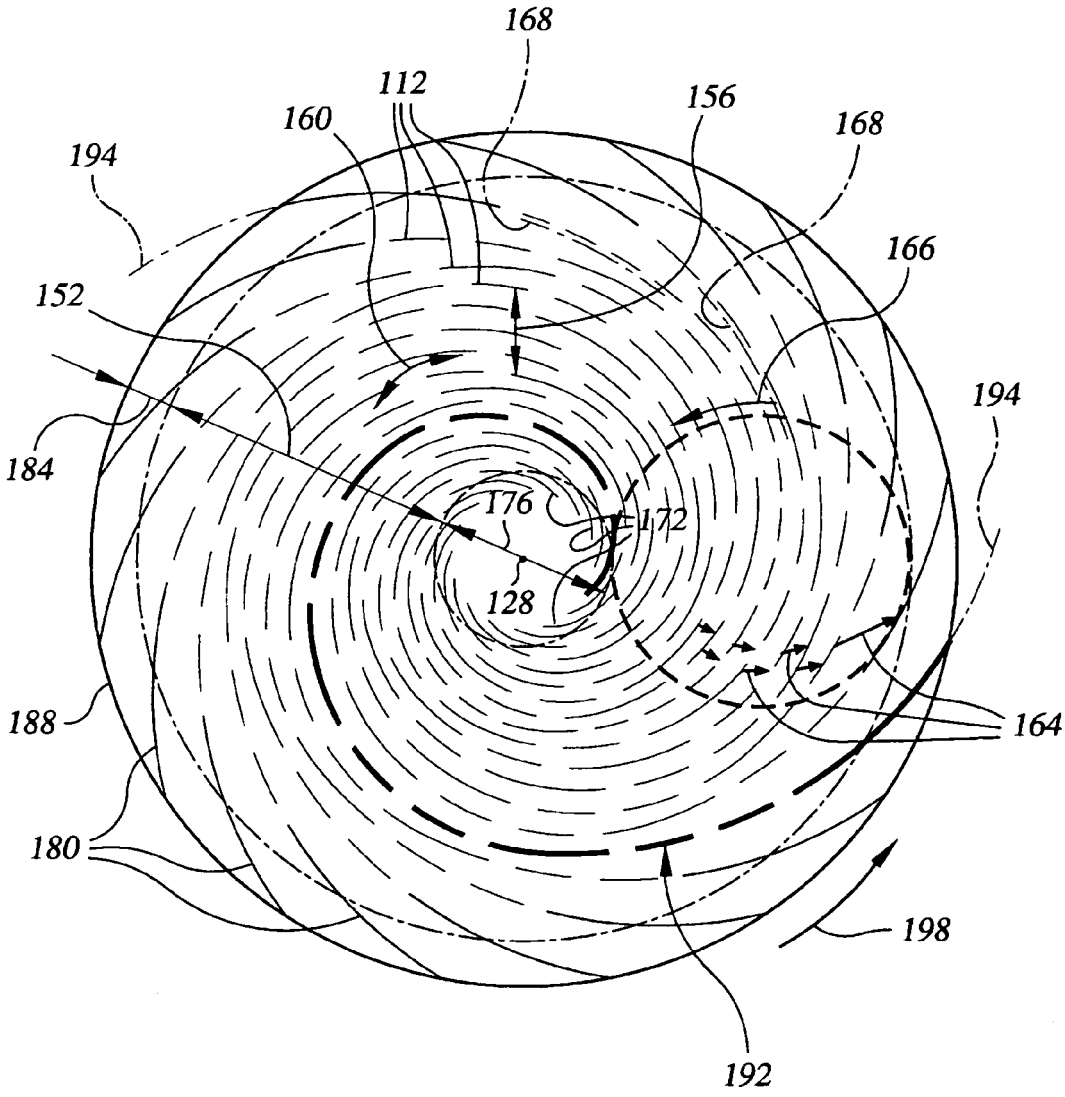
FIG. 2 is a plan view of the polishing pad of FIG. 1.

FIG. 2 illustrates polishing pad 104 of FIG. 1 in more detail. Grooves 112 are arranged within polishing track 152 so that they are spaced from one another in both a radial direction 156 and a circumferential direction relative to the rotational nature of polishing pad 104. During polishing, the polishing medium, e.g., polishing medium 116 of FIG. 1, moves from groove 112 to groove 112 within polishing track 152 (as illustrated by arrows 164) primarily only under the influence of wafer 120 as the wafer is rotated in confronting relationship with polishing pad 104, e.g., in rotational direction 166. Since the polishing medium generally moves only when wafer 120 is present, the polishing medium tends to be utilized more efficiently than with conventional pads (not shown) having grooves that extend uninterrupted through the polishing track. This is so because a polishing medium often flows through the polishing track in these uninterrupted grooves under the influence of the rotation of the pad regardless of whether or not the wafer is present. Consequently, under these circumstances a polishing medium will often be used more rapidly with a conventional polishing pad than with a polishing pad, such as pad 104, of the present invention. This more rapid usage of a polishing medium by conventional polishing pads can have a number of drawbacks, including consumption of more polishing medium than optimally necessary and, for polishing that is enhanced by polishing byproducts, the level of byproducts being lower than optimal.

In addition to grooves 112 being spaced from one another radially and circumferentially, it is desirable that at least a portion of the longitudinal axis 168 of each groove be oriented non-circumferentially relative to polishing pad 104. In other words, it is desirable that longitudinal axes 168 of grooves 112 not be merely arcs of circles concentric with rotational axis 128 of polishing pad 104. Providing such grooves 112 can facilitate the flow of a polishing medium as polishing pad 104 is rotated due to the effects of centrifugal forces caused by the rotation. In the present example, grooves 112 are generally arcs of spirals and, therefore, are non-circumferential along their entire lengths. In some, but not necessarily all, groove arrangements of the present invention, it is desirable that the distance between endpoints of each groove along a straight line connecting the endpoints be less than the least dimension of the surface of the substrate being polished that extends through the rotational center of that surface. For example, for a circular surface rotated about its concentric center, the straight-line distance between the endpoints of each groove using this criterion would be a value less than the diameter of the surface. On the other hand, for a rectangle having long sides of length L and short sides of length S, under this criterion the straight line distance between the endpoints of a groove would be a value less than the short side length S.

Grooves 112 may also include a subset 172 located partially in a central region 176 of polishing layer 108 radially inward of polishing track 152 and partially in the polishing track. This subset 172 of grooves 112 is useful, e.g., in the context of polishing systems, such as CMP system 100 of FIG. 1, in which a polishing medium is dispensed into central region 176, for enhancing the flow of the polishing medium from the central region into polishing track 152. In addition, grooves 112 may include a subset 180 of grooves that extend from polishing track 152 to a peripheral region 184 (if any) radially outward of the polishing track. Grooves 112 in subset 180 may also extend to the peripheral edge 188 of polishing pad 104, if desired. Subset 180 of grooves 112 is useful, e.g., for enhancing the flow of the polishing medium out of polishing track 152.

As will become readily apparent from FIG. 3 discussed below, grooves 112 may have any of a wide variety of arrangements and configurations. However, in FIG. 2 grooves 112 are arranged end-to-end in groups 192 so that the grooves in each group extend along a corresponding smooth path, in this case a spiral path 194, that extends from central region 176, through polishing track 152 and to peripheral edge 188. As those skilled in the art will appreciate, groups 192 of grooves 112 may be arranged in a similar manner along smooth paths of other shapes and orientations, such as straight and radial, straight and angled into or away from the design rotational direction 198 of polishing pad 104, circularly arced and generally radial, circularly arced and non-radial, among many others.

Figure 3:
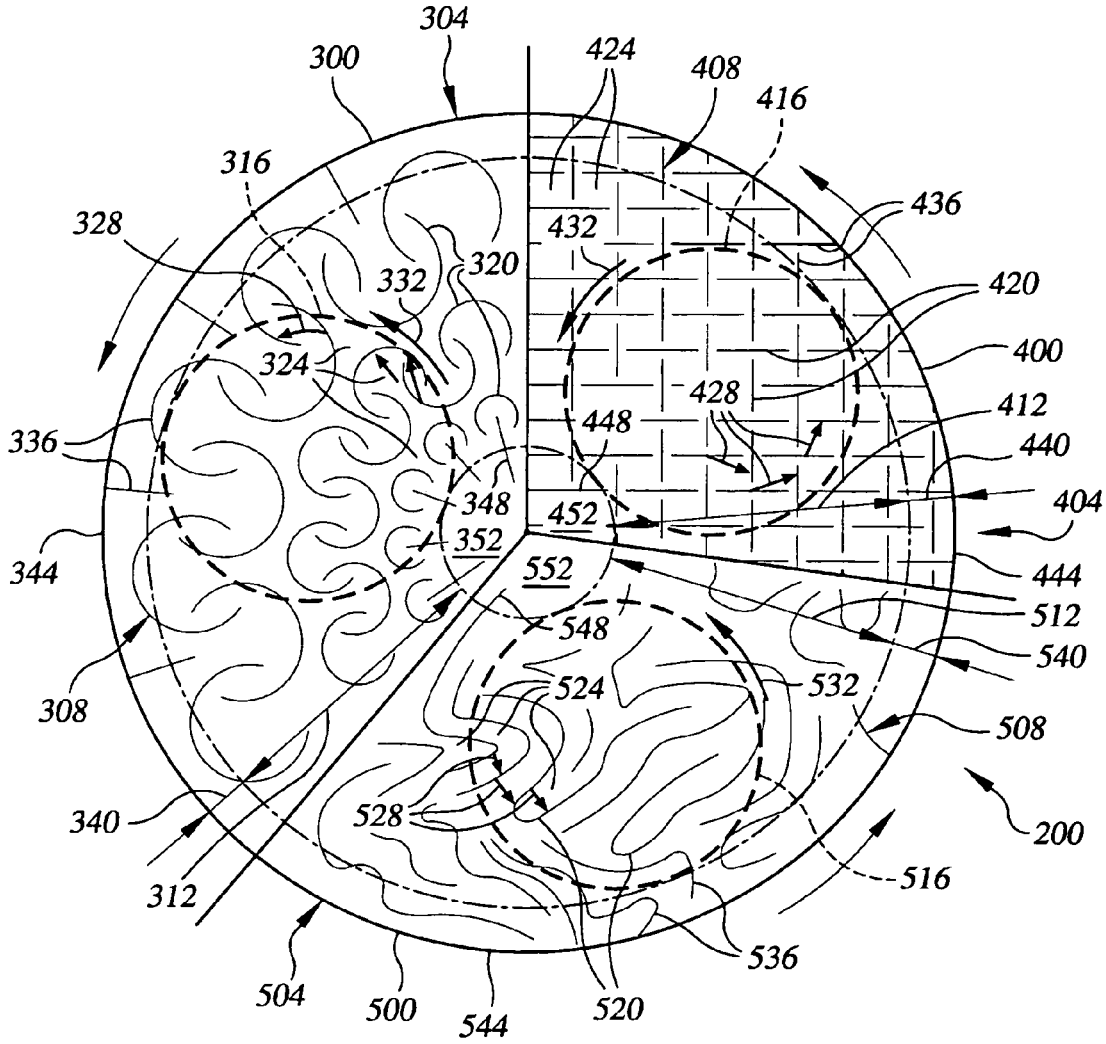
FIG. 3 is a plan view of a composite of three alternative polishing pads of the present invention illustrating three different groove arrangements.

FIG. 3 shows a composite 200 of three circle segments 300, 400, 500 of different polishing pads 304, 404, 504 of the present invention. Segments 300, 400, 500 include three respective groove arrangements 308, 408, 508 that are different from one another. However, all three provide "broken" pathways for a polishing medium to move within each respective polishing track 312, 412, 512 primarily under the influence of the corresponding wafer 316, 416, 516 as the wafer is rotated in confrontation with that polishing pad 304, 404, 504 as discussed above relative to FIG. 2. As discussed above, these broken paths are defined by spaced-apart grooves 320, 420, 520, which generally allow the polishing medium to flow under the influence of the rotation of the polishing pads 304, 404, 504. The land areas 324, 424, 524 between grooves 320, 420, 520, in contrast, generally inhibit the movement of a polishing medium, except when the respective wafers 316, 416, 516 are rotated in direct confrontation with the land areas. Respective arrows 328, 428, 528 in each segment 300, 400, 500 represent the movement of a polishing medium across land areas 324, 424, 524 caused by the rotation of the corresponding wafer 316, 416, 516 in the rotational direction 332, 432, 532 shown. In a preferred embodiment, the straight-line distance between the endpoints of each of grooves 320, 420, 520 is less than the diameter of the corresponding wafer 316, 416, 516. Generally, this feature prevents the polishing slurry from passing unimpeded beneath the corresponding wafer 316, 416, 516 without participating in polishing.

Each groove arrangement 308, 408, 508 includes respective grooves 336, 436, 536 that extend from within the corresponding polishing track 312, 412, 512 at least into the corresponding peripheral region 340, 440, 540 and in some cases to the peripheral edge 344, 444, 544. Grooves 336, 436, 536 generally enhance the transport of the polishing medium out of polishing track 312, 412, 512. Each groove arrangement 308, 408, 508 also includes grooves 348, 448, 548, respectively, that extend from the corresponding central region 352, 452, 552 into polishing track 312, 412, 512. When any one of these pads 304, 404, 504 is used with a polishing system, such as CMP system 100 of FIG. 1, that supplies a polishing medium to the pad in the respective central region 352, 452, 552, the corresponding grooves 348, 448, 548 would enhance the transport of the polishing medium from the central region into polishing track 312, 412, 512. Similar to grooves 320, 420, 520, the straight line distances between the endpoint of each of grooves 336, 436, 536, 348, 448, 548 within the corresponding polishing track 312, 412, 512 and the point where the same groove crosses the boundary of the polishing track is preferably also less than the diameter of the respective wafer 316, 416, 516. As with polishing pad 104 of FIG. 2, grooves 336, 436, 536 or grooves 348, 448, 548, or both sets, need not be provided in alternative embodiments.

Arrangements 308, 408 each include grooves 320, 336, 348, 420, 436, 448 arranged in a regular pattern. In the case of arrangement 308, grooves 320, 336, 348 have two general configurations, a partial-circle configuration and a linear configuration. As with grooves 112 of FIG. 2, grooves 320 are spaced from one another both radially and circumferentially and have non-circumferential portions. As mentioned above, the straight line distance between the endpoints of each groove 320 is preferably less than the diameter of wafer 316. Alternatives using full-circle grooves (not shown) can be readily envisioned, e.g., by removing from arrangement interposing ones of grooves 320, 336, 348 and making the remaining partial-circle grooves completely circular. Other partial or completely closed groove shapes, such as polygonal or oval, among others, may be used, if desired.

Arrangement 408 is generally a variation on a rectangular grid of grooves. However, instead of the continuous grooves of such a grid crisscrossing one another to form intersections, grooves 420, 436, 448 of arrangement 408 are configured so as to eliminate the intersections. Again, like grooves 112 of FIG. 2, grooves 420 of arrangement 408 are spaced radially and circumferentially from others of grooves 420 within polishing track 412 in the arrangement and are entirely non-circumferential relative to polishing pad 404. As noted above, each of grooves 420, 436, 448 preferably has a length that is less than the diameter of wafer 416. Alternatives based on other crisscrossing arrangements, such as rhomboidal grids and grids containing wavy, curved or zigzag grooves can readily be envisioned.

Of the several arrangements disclosed herein, arrangement 508 perhaps best illustrates an extreme to which the underlying concepts of the present invention can be taken. Grooves 520 of arrangement 508 are generally free-form, with various configurations, orientations and lengths. However, even with arrangement 508, it can be seen that grooves 520 within polishing track 512 are spaced from one another both radially and circumferentially and are (mostly) non-circumferential relative to polishing pad 504. Again, the straight-line distance between the endpoints of any free-form groove 520 that lies fully within wafer track 512 is preferably less than the diameter of wafer 516, even though in some cases the distance following the shape of the groove exceeds the diameter of the wafer. Further, for any groove 548, 536 that lies partially within and partially outside of wafer track 512, the distance between the endpoint of each such groove within the wafer track and the point where that groove crosses a boundary of the wafer track is also preferably less than the diameter of the wafer. Consequently, these free-form grooves 520, 536, 548 act in concert with one another to enhance polishing medium utilization by moving a polishing medium from one groove to the next substantially only under the influence of wafer 516.

The invention claimed is:

1. A polishing pad, comprising:

a) a polishing layer configured to polish a surface of at least one of a magnetic, optical or semiconductor substrate in the presence of a polishing medium, the polishing layer including a rotational axis, an outer periphery and an annular polishing track concentric with the rotational axis; and b) a plurality of grooves formed in the polishing layer and comprising a first set of grooves located entirely within the annular polishing track, each groove in the first set of grooves:

i) being spaced from other grooves in the first set of grooves in a radial direction relative to the rotational axis;

ii) being spaced from other grooves in the first set of grooves in a circumferential direction relative to the polishing pad; and iii) having a longitudinal axis at least a portion of which is oriented non-circumferentially relative to the polishing pad forming a discontinuous flow for the polishing medium where land regions interrupt flow to the outer periphery.

2. The polishing pad according to claim 1, wherein the surface of the substrate has a rotational center and includes a least dimension along a line extending through the rotational center, each groove in the first set of grooves having a first end and a second end spaced from the first end by a distance less than the least dimension of the surface.

3. The polishing pad according to claim 1, wherein the plurality of grooves are arranged in a plurality of groups each containing ones of the plurality of grooves arranged end-to-end along a smooth path.

4. The polishing pad according to claim 3, wherein each of the plurality of grooves is curved.

5. The polishing pad according to claim 1, wherein said polishing layer further comprises a peripheral region extending between the annular polishing track and the outer periphery, the plurality of grooves further comprising a second set of grooves each of which is present only in the annular polishing track and the peripheral region.

6. The polishing pad according to claim 1, wherein the annular polishing track has an inner periphery defining a central region of the polishing layer, the plurality of grooves further comprising a third set of grooves each of which is present only in the annular polishing track and the central region.

7. A polishing pad, comprising:

a) a polishing layer configured to polish a surface of at least one of a magnetic, optical or semiconductor substrate in the presence of a polishing medium, the polishing layer including:

i) a rotational axis;

ii) an outer periphery;

iii) an annular polishing track concentric with the rotational axis; and iv) a peripheral region located between the annular polishing track and the outer periphery; and b) a plurality of grooves formed in the polishing layer and comprising:

i) a first set of grooves located entirely within the annular polishing track, each of at least some of the grooves in the first set of grooves:

A) spaced from others of the grooves in the first set of grooves in a radial direction relative to the rotational axis of the polishing layer; and B) spaced from others of the grooves in the first set of grooves in a circumferential direction relative to the polishing pad; and ii) a second set of grooves each located only in the annular polishing track and the peripheral region forming a discontinuous flow for the polishing medium where land regions interrupt flow to the outer periphery.

8. The polishing pad according to claim 7, wherein the polishing track further includes an inner periphery, the polishing layer further including:

a) a central region concentric with the rotational axis and defined by the inner periphery of the annular polishing track; and b) a third set of grooves each located only in the central region and the annular polishing track.

9. The polishing pad according to claim 7, wherein each groove in the first set of grooves has a longitudinal axis at least a portion of which is oriented non-circumferentially relative to the polishing pad.

10. The polishing pad according to claim 7, wherein the plurality of grooves are arranged in a plurality of groups each containing ones of the plurality of grooves arranged end-to-end along a smooth path.

* * * * *